US008342656B2

(12) United States Patent
Matsuzawa et al.

(10) Patent No.: US 8,342,656 B2
(45) Date of Patent: Jan. 1, 2013

(54) LIQUID EJECTING HEAD AND LIQUID EJECTING APPARATUS

(75) Inventors: Akira Matsuzawa, Shiojiri (JP); Mutsuhiko Ota, Matsumoto (JP); Tetsushi Takahashi, Nagano-ken (JP); Yasuyuki Matsumoto, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/299,693

(22) Filed: Nov. 18, 2011

(65) Prior Publication Data

US 2012/0062655 A1 Mar. 15, 2012

Related U.S. Application Data

(63) Continuation of application No. 11/854,359, filed on Sep. 12, 2007, now Pat. No. 8,061,813.

(30) Foreign Application Priority Data

Sep. 13, 2006 (JP) ..... 2006-248741

(51) Int. Cl.
*B41J 2/045* (2006.01)
*B41J 2/05* (2006.01)

(52) U.S. Cl. ..... 347/56; 347/68

(58) Field of Classification Search ..... 347/56, 347/68

See application file for complete search history.

(56) References Cited

U.S. PATENT DOCUMENTS 5,896,150 A 4/1999 Kobayashi et al.
2005/0012784 A1 1/2005 Ito

FOREIGN PATENT DOCUMENTS

JP 2005-153243 6/2005

OTHER PUBLICATIONS

U.S. Appl. No. 11/854,359, mailed Oct. 6, 2010, Office Action.
U.S. Appl. No. 11/854,359, mailed Mar. 17, 2011, Final Office Action.
U.S. Appl. No. 11/854,359, mailed Jul. 12, 2011, Notice of Allowance.

*Primary Examiner* — Jerry Rahll
(74) *Attorney, Agent, or Firm* — Workman Nydegger

(57) ABSTRACT

A liquid ejecting head that includes a fluid channel formation substrate and pressure generation units. The fluid channel formation substrate is made of a silicon single crystal substrate having a crystal face orientation of. The fluid channel formation substrate has a plurality of separate flow channels that include at least pressure generation chambers demarcated by partition walls, each of the pressure generation chambers being in communication with a nozzle opening that ejects liquid drops. The fluid channel formation substrate further has a communication portion that is in communication with each of the separate flow channels. The pressure generation units are provided so as to correspond to the pressure generation chambers and generate a pressure change in the pressure generation chambers so as to cause ejection of liquid drops.

7 Claims, 6 Drawing Sheets

LIQUID EJECTING HEAD AND LIQUID EJECTING APPARATUS

This application is a Continuation of U.S. patent application Ser. No. 11/854,359 filed on Sep. 12, 2007 which claims priority to Japanese Patent Application No. 2006-248741, filed Sep. 13, 2006 which is expressly incorporated by reference herein.

BACKGROUND

1. Technical Field

The present invention relates to a liquid ejecting head that ejects liquid drops from its nozzle openings, and a liquid ejecting apparatus that is provided with such a liquid ejecting head. More particularly, the present invention relates to an ink-jet recording head that ejects ink drops as one specific example of various kinds of liquid drops, and an ink-jet recording apparatus that is provided with such an ink-jet recording head.

2. Related Art

A typical example of various kinds of liquid ejecting heads is an ink-jet recording head, which is used, for example, in a printer, a facsimile machine, and a copying machine. Some of ink-jet recording heads have a fluid channel formation substrate, which has liquid flow channels having pressure generation chambers (i.e., compartments) each of which constitutes a part of the liquid flow channel and is in communication with a nozzle opening, and piezoelectric elements, which are provided over one surface of the fluid channel formation substrate, specifically, at regions opposed to the pressure generation chambers with a diaphragm (i.e., vibrating plate) interposed therebetween. For example, according to the configuration described in JP-A-2005-153243, a fluid channel formation substrate has pressure generation chambers, a communication portion (i.e., space) that retains (i.e., reservoirs) ink to be supplied to each of the pressure generation chambers, ink supply passages and communication passages through which the communicating portion is in communication with each of the pressure generation chambers. With such a configuration, piezoelectric elements are "voltage-deflected" to cause the deformation of a diaphragm, which results in expansion/contraction of the inner capacity of the pressure generation chambers. By this means, ink is supplied from the communication portion to the pressure generation chambers via the communication passages and the ink supply passages; and ink drops are ejected from nozzle orifices (i.e., holes).

In the configuration of related art, there is a problem in that "air bubble entrainment (drift of air bubbles)" could occur at the boundaries between the communicating portion and separate flow channels, each of which is demarcated by partition walls and is made up of a pressure generation chamber and fluid passages. That is, such a phenomenon could occur at each boundary between the communication passage and the communication portion. In a typical configuration of related art, the tip surface of each partition wall at the communication-portion side is formed as a flat surface that is either substantially/approximately perpendicular or slanted with respect to the surface of fluid channel formation substrate. For this reason, it is possible that air bubbles that are entrained in ink collide against the tip surface of the partition wall. As a result of such a collision, the air bubbles entrained in ink could drift and thus remain at, for example, a corner portion that is formed by the partition wall and a diaphragm (i.e., elastic membrane). Then, the growth of the air bubbles that remain at the corner portion adversely affects ink-drop-ejecting characteristics of the related-art configuration, causing a problem such as missing dots, a decrease in ejection amount, or the like.

Needless to say, the same problem occurs in liquid ejecting heads that eject various kinds of liquids other than ink drops.

SUMMARY

An advantage of some aspects of the invention is to provide a liquid ejecting head and a liquid ejecting apparatus that prevents air bubbles from remaining in liquid flow channels for the purpose of enhancing liquid-drop-ejecting characteristics.

In order to address the problem of related art identified above without any limitation thereto, a liquid ejecting head according to a first aspect of the invention includes: a fluid channel formation substrate that is made of a silicon single crystal substrate having a crystal face orientation of (110), the fluid channel formation substrate having a plurality of separate flow channels that include at least pressure generation chambers demarcated by partition walls, each of the pressure generation chambers being in communication with a nozzle opening that ejects liquid drops, and the fluid channel formation substrate further having a communication portion that is in communication with each of the separate flow channels; and a pressure generation section that is provided so as to correspond to each of the pressure generation chambers, the pressure generation section generating a pressure change in the pressure generation chambers so as to cause ejection of liquid drops, wherein the tip surface at the communication portion side of each of the partition walls has a gradual diminution portion formed thereon, the gradual diminution portion being, in the thickness direction of the partition wall, slanted downward toward the communication portion, and the gradual diminution portion having an angle of gradient that gradually decreases toward one end portion of the partition wall (in the width direction thereof). With the above-described configuration of a liquid ejecting head according to the first aspect of the invention that adopts a fluid channel formation substrate made of a silicon single crystal substrate having a crystal face orientation of (110), liquid flows more smoothly at the end portion of each of the partition walls because the angle of gradient at the tip surface of said each of the partition walls is comparatively small. For this reason, the invention makes it possible to effectively prevent air bubbles from drifting and thus remaining in the liquid flow channels, in particular, at the end portion of each of the partition walls. Advantageously, this improves liquid drop ejecting characteristics of the head.

In the configuration of a liquid ejecting head according to the invention described above, it is preferable that each of the gradual diminution portions is configured as a curved surface. Such a configuration offers, advantageously, a further smooth flow of liquid at the end portion of each of the partition walls. Therefore, it is possible to effectively prevent air bubbles from drifting and thus remaining in the liquid flow channels with a greater reliability.

In the configuration of a liquid ejecting head according to the invention described above, it is preferable that the entire region of the tip surface of each of the partition walls is slanted downward toward the communication portion. Such a configuration offers, advantageously, a further smooth flow of liquid at the end portion of each of the partition walls. Therefore, it is possible to effectively prevent air bubbles from drifting and thus remaining in the liquid flow channels with a greater reliability.

In the configuration of a liquid ejecting head according to the invention described above, it is preferable that the gradual diminution portion only constitutes the tip surface of each of the partition walls. Such a configuration offers, advantageously, a further smooth flow of liquid at the end portion of each of the partition walls. Therefore, it is possible to effectively prevent air bubbles from drifting and thus remaining in the liquid flow channels with a greater reliability.

In the configuration of a liquid ejecting head according to the invention described above, it is preferable that an end portion of each of the partition walls at the communication-portion side is configured as a narrow width portion that has a decreasing width toward a tip thereof. Such a configuration offers, advantageously, a further smooth flow of liquid at the end portion of each of the partition walls because the tip surface of said each of the partition walls is formed not to be orthogonal to the direction in which liquid flows but to be slanted at a certain angle with respect thereto.

In the configuration of a liquid ejecting head according to the invention described above, it is preferable that each of the separate flow channels includes a liquid supply passage that is in communication with the pressure generation chamber and is configured to have a relatively small sectional area (i.e., cross section) along a width direction thereof in comparison with that of the pressure generation chamber, and said each of the separate flow channels further includes a communication passage through (i.e., via) which the liquid supply passage is in communication with the communication portion, the communication passage being configured to have a relatively large sectional area along a width direction thereof in comparison with that of the liquid supply passage. Such a configuration offers, advantageously, more smooth flow of liquid at the boundary between the communication portion and each of the communication passages. Therefore, it is possible to effectively prevent air bubbles from drifting and thus remaining in the liquid flow channels in a reliable manner. Since such a configuration makes it possible to supply liquid from the communication portion to each of the pressure generation chambers with a good liquid supply performance, liquid drop ejecting characteristics of the head is enhanced with a greater reliability.

In order to address the aforementioned problem of related art identified above without any limitation thereto, the invention provides a liquid ejecting apparatus that is provided with the liquid ejecting head having any of the configurations described above. Having such a liquid ejecting head, the liquid ejecting apparatus according to the invention offers, advantageously, improved characteristics such as reliability, durability, or the like.

BRIEF DESCRIPTION OF THE DRAWINGS

The invention will be described with reference to the accompanying drawings, wherein like numbers reference like elements.

FIG. 2A is a plane view of the recording head according to the exemplary embodiment of the invention, whereas

FIG. 4A is an enlarged plane view of the tip portions of the partition walls according to the exemplary embodiment of the invention, whereas

DESCRIPTION OF EXEMPLARY EMBODIMENTS

With reference to the accompanying drawings, exemplary embodiments of the present invention are described in detail below.

Exemplary Embodiment

Figure 1:
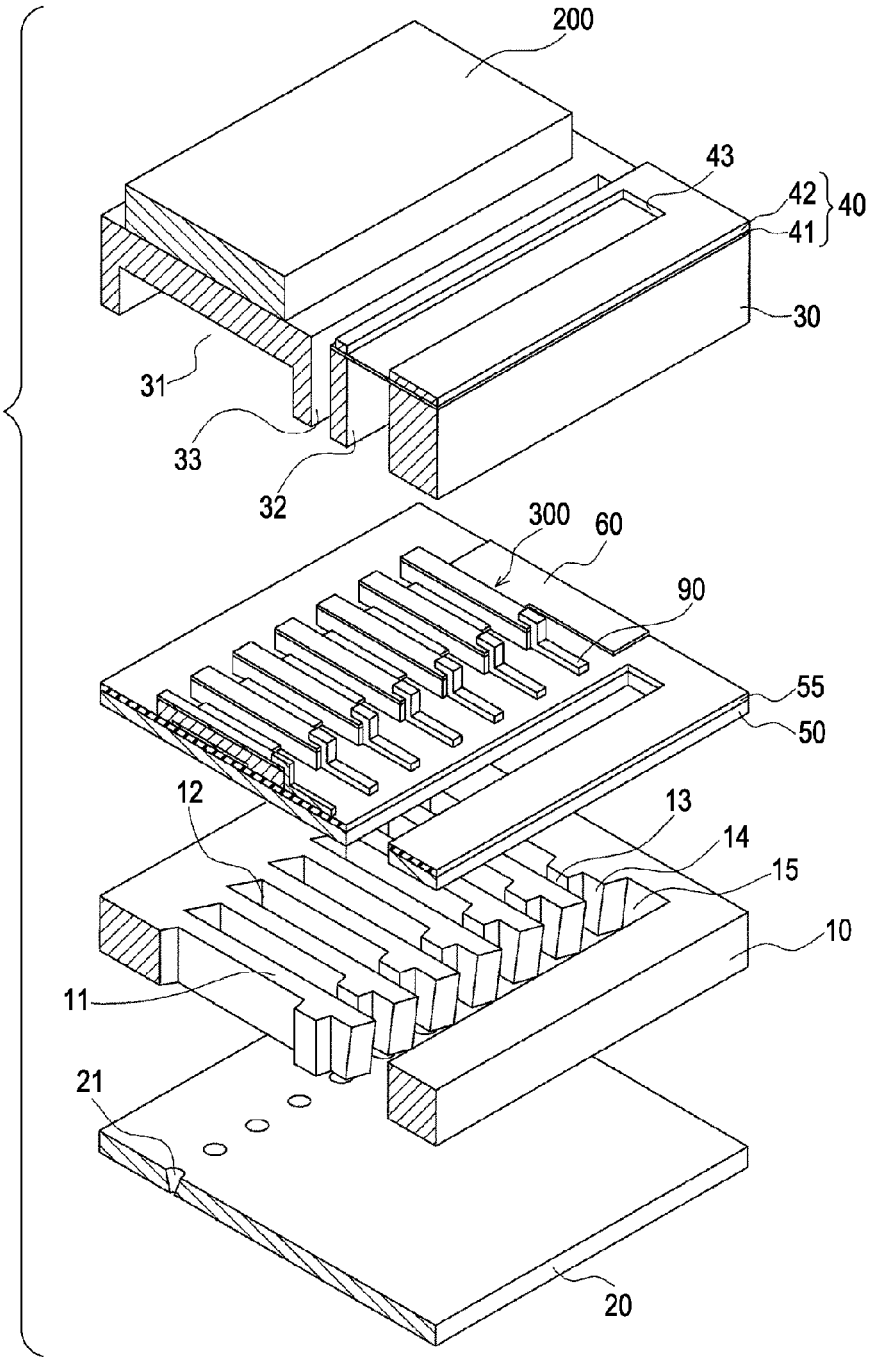
FIG. 1 is an exploded perspective view of the overall configuration of a recording head according to an exemplary embodiment of the invention.
Figure 2A:
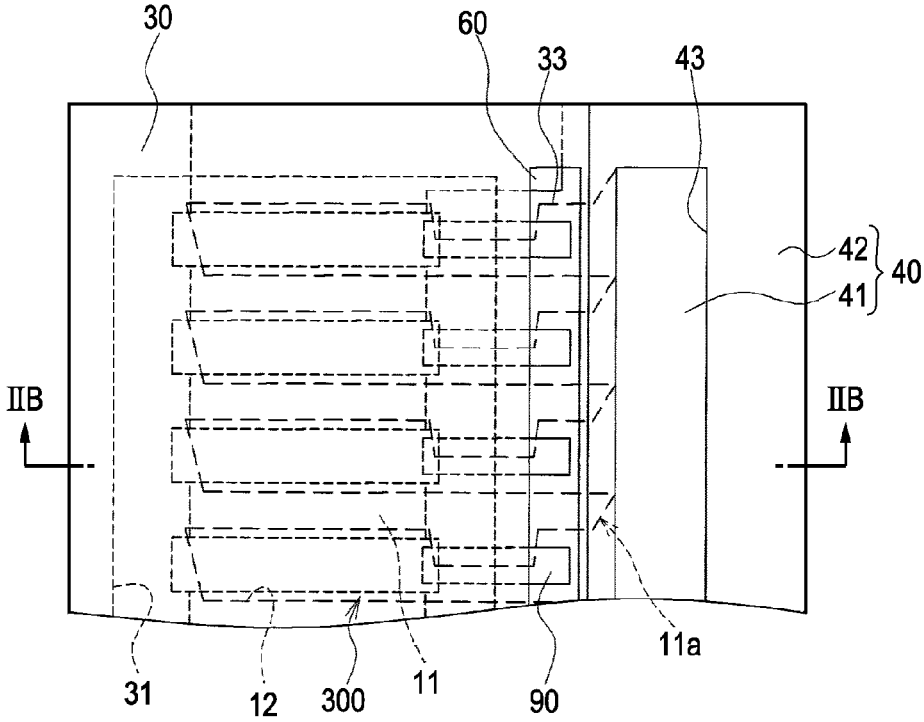
Figure 2B:
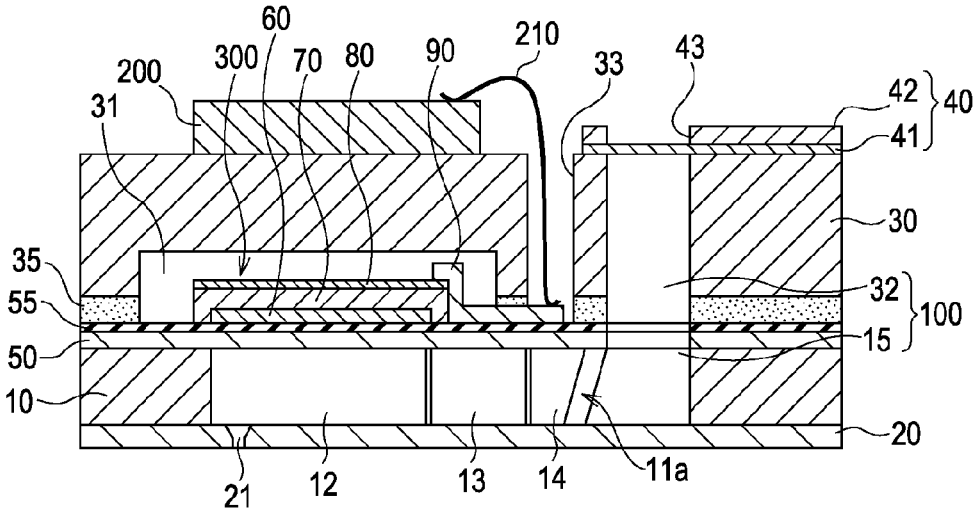
FIG. 2B is a sectional view thereof.
Figure 3:
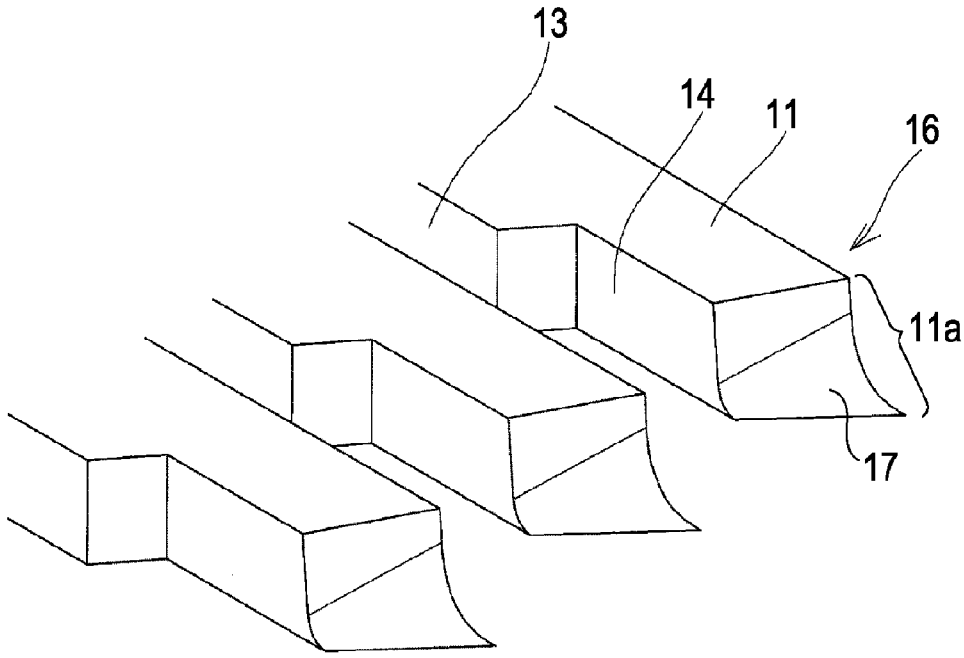
FIG. 3 is a perspective view that schematically illustrates an example of the tip portions of partition walls according to the exemplary embodiment of the invention.
Figure 4A:
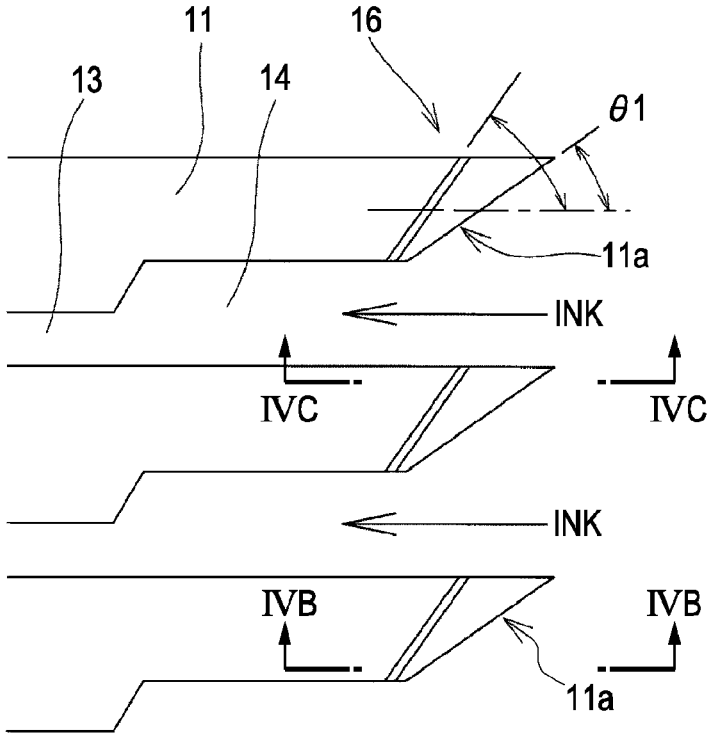
Figure 4B:
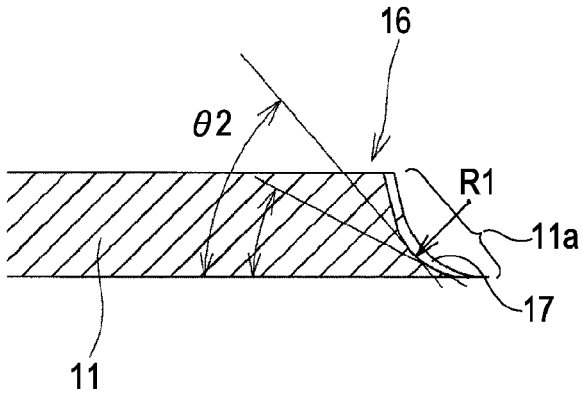
FIGS. 4B and 4C are enlarged sectional views thereof.
Figure 4C:
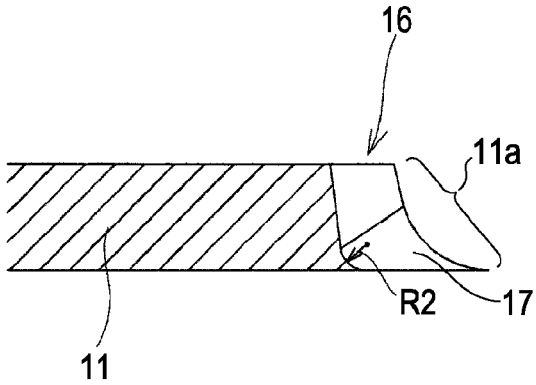

FIG. 1 is an exploded perspective view of the overall configuration of an ink-jet recording head, which is illustrated herein as an example of a liquid ejecting head according to the present embodiment of the invention. FIG. 2A is a plane view of the ink-jet recording head illustrated in FIG. 1, whereas FIG. 2B is a sectional view taken along the line IIB-IIB thereof. FIG. 3 is a perspective view that schematically illustrates an example of the tip portions of partition walls. FIG. 4A is an enlarged plane view of the tip portions of partition walls, whereas FIGS. 4B and 4C are enlarged sectional views thereof.

In this embodiment of the invention, a fluid channel formation substrate 10 is made of a silicon single crystal substrate having a crystal face orientation of (110). As illustrated in the drawing, an elastic membrane 50 is pre-formed through thermal oxidation on one surface of the fluid channel formation substrate 10. The pre-formed elastic membrane 50, which is made of silicon oxide ($SiO_2$), has a thickness of 0.5-2.0 μm. The fluid channel formation substrate 10 has separate flow channels, which are partly constituted by a plurality of pressure generation chambers 12 demarcated by partition walls 11. The separate flow channels are arrayed in parallel with one another along the width direction of the fluid channel formation substrate 10. As an exemplary configuration in this embodiment of the invention, ink supply passages 13 and communication passages 14 that are demarcated by the partition walls 11 and are in communication with the pressure generation chambers 12, are formed next to one longitudinal end of the pressure generation chambers 12 of the fluid channel formation substrate 10. Each of the separate flow channels is made up of, in this example, the pressure generation chamber 12, the ink supply passage 13, and the communication passage 14. A communication portion (i.e., space) 15 is formed at the outside area of the communication passages 14 each of which constitutes a part of the separate flow channel. The communication portion 15 is in communication with each of the communication passages 14. In communication with a reservoir portion 32 of a protection substrate 30, which will be described later, the communication portion 15 (and the reservoir portion 32) constitutes a reservoir 100.

Each of the ink supply passages 13 is configured to have a relatively small sectional area (i.e., cross section) along the width direction in comparison with that of the corresponding pressure generation chamber 12. Having a smaller sectional area, each of the ink supply passages 13 keeps the flow-channel resistance of ink that flows from the communication portion 15 into the corresponding pressure generation chamber 12 at a constant level. For example, in this embodiment of the invention, the ink supply passage 13 is configured to have a smaller width than that of the pressure generation chamber 12. Each of the communication passages 14 is formed by extending both sides of, viewed in the width direction, the partition walls 11 toward the communication portion 15 so as to demarcate a space between the ink supply passage 13 and the communication portion 15. The communication passage 14 is configured to have a larger width than that of the ink supply passage 13. For example, in this embodiment of the invention, the communication passage 14 has approximately the same width as that of the pressure generation chamber 12. In other words, the communication passage 14 is configured to have a relatively large sectional area along the width direction in comparison with that of the ink supply passage 13.

As has already been described, in this embodiment of the invention, the fluid channel formation substrate 10 is made of a silicon single crystal substrate having a crystal face orientation of (110). All elements of the flow channels such as the pressure generation chambers 12 are formed by performing anisotropic etching on the fluid channel formation substrate 10 by means of, for example, an etchant such as KOH water solution or the like. Therefore, for example, the side surface of the pressure generation chamber 12 is made up of a first surface (111) that is perpendicular to the crystal face orientation surface (110) and a second surface (112) that forms an angle of approximately 70 degrees with the first surface (111) and an angle of approximately 35 degrees with the crystal face orientation surface (110). In addition, as a result of forming the flow channels by performing anisotropic etching on the fluid channel formation substrate 10, the tip portions of the partition walls 11 that demarcate the separate flow channels including the pressure generation chambers 12, in other words, the end portions of the partition walls 11 at the communication-portion (15) side, are configured as narrow width portions 16 each of which has a decreasing width (i.e., a tapering structure) toward its tip (i.e., toward the communication portion 15). Each of the narrow width portions 16 according to this exemplary embodiment of the invention has a width that decreases gradually from one edge/side (i.e., either left or right) of the partition wall 11 toward its tip. Accordingly, in the inner configuration of the fluid channel formation substrate 10, the tip surface 11*a* of each of the partition walls 11 is formed not to be orthogonal to the direction in which ink flows, that is, the longitudinal direction of the pressure generation chamber 12, but to be slanted at a certain angle θ1 with respect thereto.

In addition, a gradual diminution portion 17 is formed on the tip surface 11*a* of each of the partition walls 11. The gradual diminution portion 17 is, in the thickness direction of the partition wall 11, slanted downward toward the communication portion 15, and has an angle of gradient θ2 that gradually decreases toward one end portion thereof in the thickness direction. For example, according to the exemplary structure of the gradual diminution portion 17 provided in an exemplary configuration illustrated in this embodiment of the invention, the entire region (i.e., surface) of the tip surface 11*a* of the partition wall 11 is slanted downward from the nozzle plate (20) side toward the elastic membrane (50) side, and a curved surface is formed in the proximity of the end portion at the elastic membrane (50) side of the tip surface 11*a* of the wall partition 11. That is, since the exemplary configuration illustrated in this embodiment of the invention is provided with the gradual diminution portions 17, the angle of gradient θ2 at the tip surface 11*a* of each of the partition walls 11 is configured to be as small as practicable at the end portion at the elastic membrane (50) side. It should be noted that the radius of curvature of the gradual diminution portion 17 does not have to be constant throughout the width direction of the partition wall 11. For example, in this embodiment of the invention, the radius of curvature of the gradual diminution portion 17 is at its maximum at the tip of the partition wall 11. For example, as illustrated in a set of FIG. 4, the radius of curvature R1 of the gradual diminution portion 17 taken along the line IVB-IVB is configured to be larger than the radius of curvature R2 of the gradual diminution portion 17 taken along the line IVC-IVC. For this reason, in this embodiment of the invention, the angle of gradient θ1 of the tip surface 11*a* of the partition wall 11 with respect to the direction in which ink flows decreases gradually from the nozzle plate (20) side toward the elastic membrane (50) side.

Such a configuration contributes to more smooth flow of ink in the proximity of the tip surface 11*a* of each of the partition walls 11. Therefore, it is possible to avoid the occurrence of "air bubble entrainment (drift of air bubbles)" effectively at an area near the tip surface 11*a* of the partition wall 11. Specifically, when ink is fed from the communication portion 15 to each of the pressure generation chambers 12 via the communication passage 14 and the ink supply passage 13, the exemplary configuration of the embodiment of the invention described above makes it possible to effectively prevent air bubbles entrained in ink from drifting and thus remaining at a corner portion that is formed by the tip surface 11*a* of the partition wall 11 and the elastic membrane 50 or the nozzle plate 20. In particular, as has already been described above, the tip surface 11*a* of each of the partition walls 11 according to this embodiment of the invention is configured as the narrow width portion 16. In addition, the tip surface 11*a* of each of the partition walls 11 according to this embodiment of the invention is slanted at a certain angle θ1 with respect to the direction in which ink flows. For these reasons, it is easier for ink retained in the communication portion 15 to flow into the communication passage 14, resulting in more smooth ink flow. Therefore, it is possible to effectively avoid the occurrence of missing dots, a decrease in ink drop ejection amount, defective ink drop ejection, and/or other similar problems, which is caused by the growth of the air bubbles that remain at the corner portion.

The method of forming the partition walls 11 having the gradual diminution portions 17 at their tip surfaces 11*a* is not specifically limited in this invention; and therefore, any appropriate method may be employed. As an example thereof, with no intention of limitation thereto, the partition walls 11 having the gradual diminution portions 17 at their tip surfaces 11*a* may be formed at the same time as when the flow channels such as the pressure generation chambers 12 are formed, as has already been described, by performing anisotropic etching on the fluid channel formation substrate 10 by means of an etchant. When the flow channels such as the pressure generation chambers 12 are formed by performing anisotropic etching on the fluid channel formation substrate 10, because the tip surface 11*a* of each of the partition walls 11 according to this embodiment of the invention is configured as the narrow width portion 16, there will be a difference, although it is small, between an etching rate at the base portion of the narrow width portion 16 and an etching rate at the tip portion thereof. In addition to the above, the etching rate varies depending on etching conditions such as the concentration of an etchant, etching time, or the like. Therefore, it is possible to form the gradual diminution portions 17 at the tip surfaces 11*a* of the partition walls 11 at the same time as when the flow channels such as the pressure generation chambers 12 are formed by adjusting the etching conditions appropriately while making use of the difference in the etching rates described above.

In the present embodiment of the invention described above and illustrated in the accompanying drawings, only a part of the tip surface 11*a* of the partition wall 11 is configured as the gradual diminution portion 17. Notwithstanding the foregoing, the entire region (i.e., surface) of the tip surface 11*a* of the partition wall 11 may be configured as the gradual diminution portion 17. In the present exemplary embodiment of the invention, the entire region of the tip surface 11*a* of the partition wall 11 is slanted downward toward the elastic membrane (50) side. Notwithstanding the foregoing, the region other than the gradual diminution portion 17 may be formed to be substantially/approximately orthogonal to the surface of the elastic membrane 50.

Figure 5:
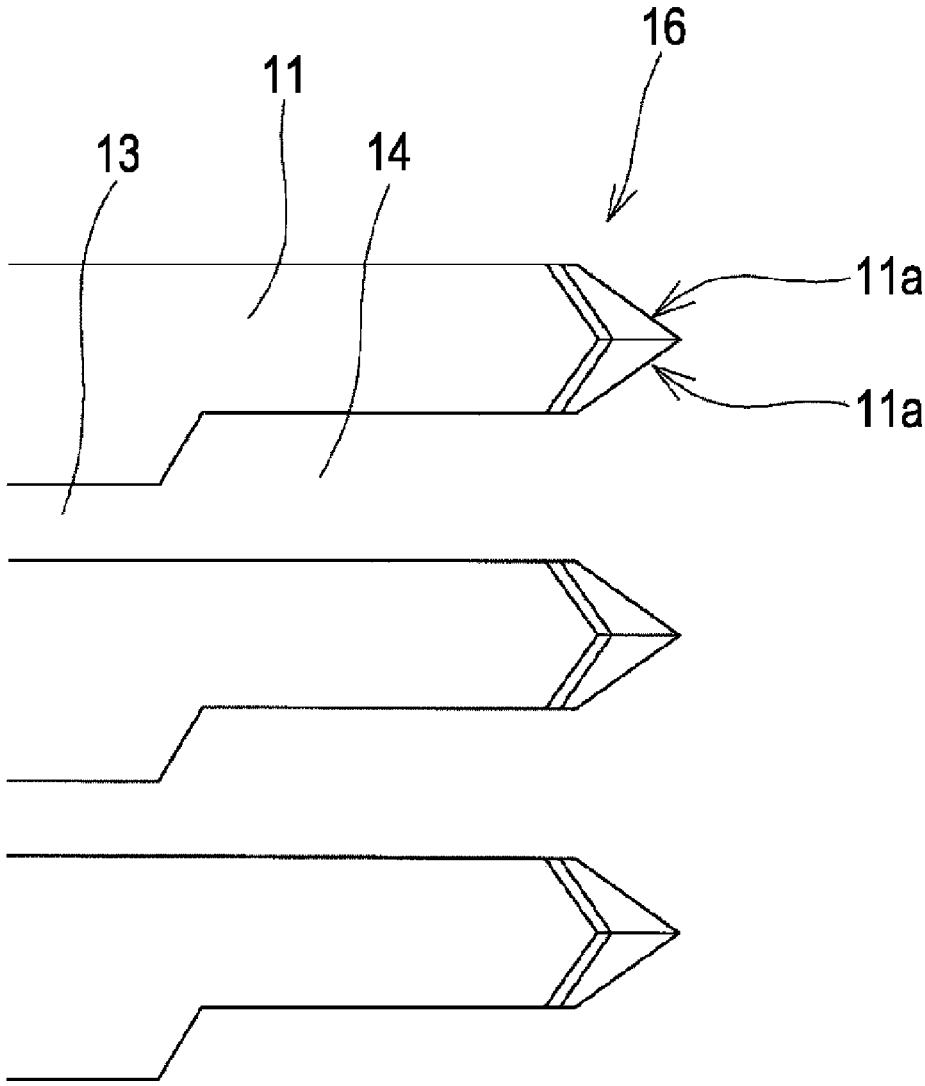
FIG. 5 is a plane view that illustrates a variation example of the shape of the tip portions of the partition walls according to the exemplary embodiment of the invention.

In the present exemplary embodiment of the invention, the narrow width portion 16 formed as the tip portion of the partition wall 11 has a width thereof that decreases gradually from one edge/side thereof toward its tip. Notwithstanding the foregoing, the invention is in no case limited to such a specific configuration. As an alternative example thereof, as illustrated in FIG. 5, the narrow width portion 16 may be configured in such a manner that the width of the partition wall 11 decreases gradually from both of two edges/sides thereof toward its tip. With such an alternative configuration, it is easier for ink retained in the communication portion 15 to flow into two of the communication passages 14 that sandwich one partition wall 11 (each two communication passages 14 that are provided horizontally in parallel with each other in the drawing), resulting in further smooth ink flow.

The nozzle plate 20 is adhered to the opening-surface-side of the fluid channel formation substrate 10 by means of an adhesive, a thermal deposition/welding film, or any other similar alternative means. A plurality of nozzle orifices (i.e., nozzle openings/nozzle holes) 21 is bored through the nozzle plate 20. Each nozzle orifice 21 is communicated with one end, or more exactly, in the proximity thereof, of each of the pressure generation chambers 12 opposite to the other end thereof next to which the ink supply passage 13 is formed. The nozzle plate 20 may be made of, for example, glass ceramics, silicon single crystal substrate, stainless steel (SUS), or the like.

As has already been described, the elastic membrane 50 having a thickness of, for example, approximately 1.0 μm is formed on the other surface of the fluid channel formation substrate 10 that is opposite to the nozzle-plate-side (20) surface thereof. An insulating film 55 having a thickness of, for example, approximately 0.4 μm is formed on the elastic membrane 50. Piezoelectric elements 300 are provided on the insulating film 55. The piezoelectric elements 300 are made up of a lower electrode film 60 having a thickness of, for example, approximately 0.2 μm, a piezoelectric substance layer 70 having a thickness of, for example, approximately 1.0 μm, and an upper electrode film 80 having a thickness of, for example, approximately 0.05 μm. Generally speaking, either one of the lower electrode 60 and the upper electrode 80 of the piezoelectric elements 300 is configured as a common electrode, whereas the other thereof as well as the piezoelectric substance layer 70 are patterned for each of the pressure generation chambers 12. In the present exemplary embodiment of the invention, the lower electrode film 60 is configured as the common electrode of the piezoelectric elements 300, whereas the upper electrode film 80 is configured as the individual electrodes thereof. Notwithstanding the foregoing, the lower electrode film 60 and the upper electrode film 80 may be reversed if it is required/advantageous because of the circuit line patterning/driving circuit layout, and/or any other similar reasons.

A lead electrode 90, which is made of gold (Au) or the like, is connected to the upper electrode film 80 of each of the piezoelectric elements 300. The lead electrodes 90 extend toward the ink-supply-passage (13) side of the fluid channel formation substrate 10. Voltages are applied in a selective manner to the piezoelectric elements 300 via the lead electrodes 90.

The protection substrate 30 is bonded to, by means of an adhesive 35, the fluid channel formation substrate 10 that has the piezoelectric elements 300 formed thereon. The protection substrate 30 has a piezoelectric element cover portion 31 at a region thereof opposed to the piezoelectric elements 300. The piezoelectric element cover portion 31 is configured to protect the piezoelectric elements 300. The piezoelectric element cover portion 31 has an inner space that is wide enough so as not to obstruct the motion of the piezoelectric elements 300. As long as the space is sufficiently large so as not to hamper the movement of the piezoelectric elements 300, it may be sealed or not sealed. The reservoir portion 32, which penetrates through the protection substrate 30 in its thickness direction, is provided at an area opposed to the communication portion 15. The reservoir portion 32 of the protection substrate 30 is in communication with the communication portion 15 of the fluid channel formation substrate 10. As has already been described, the reservoir portion 32 and the communication portion 15 make up the reservoir 100, which constitutes a common ink chamber/compartment for the pressure generation chambers 12. In the present exemplary embodiment of the invention, a through hole 33, which penetrates through the protection substrate 30 in its thickness direction, is provided between the piezoelectric element cover portion 31 of the protection substrate 30 and the reservoir portion 32 thereof. A part of the lower electrode film 60 and the tips of the lead electrodes 90 are exposed inside the through hole 33.

It is preferable that the protection substrate 30 should be made of a material having substantially the same coefficient of thermal expansion as that of the fluid channel formation substrate 10 such as glass, ceramic material, or the like. In the present exemplary embodiment of the invention, the protection substrate 30 is made of a silicon single crystal substrate having a surface orientation of (110), that is, the same material that constitutes the fluid channel formation substrate 10.

A driving circuit 200, which drives the piezoelectric elements 300, is mounted on the protection substrate 30. For example, a circuit board and semiconductor integrated circuits (IC) may constitute the driving circuit 200. The driving circuit 200 is electrically connected to the lead electrodes 90 via a connection wiring 210 that is made up of conductive wires such as bonding wires or the like. A compliance substrate 40, which is made up of a sealing film 41 and a fixation plate 42, is adhered to the protection substrate 30. The sealing film 41 is made of a flexible material having a low rigidity (for example, a polyphenylene sulfide (PPS) film having a thickness of 6 μm). The sealing film 41 seals one end of the reservoir portion 32. On the other hand, the fixation plate 42 is made of a hard material such as metal (for example, a stainless steel (SUS) having a thickness of 30 μm). Some region of the fixation plate 42 that is opposed to the reservoir 100 constitutes an opening 43, that is, an open space that penetrates through the fixation plate 42 in its thickness direction. As the fixation plate 42 has such a structure, it is the flexible sealing film 41 only that seals one end of the reservoir 100.

An ink-jet recording head according to the present embodiment of the invention having the configuration described above operates as follows. First of all, ink is fed from an external ink supply unit, which is not shown in the drawing. The inner fluid channel structure from the reservoir 100 to the nozzle orifices 21 is filled with the supplied ink. Thereafter, in accordance with a recording signal sent from the driving circuit 200, voltage is applied between the lower electrode film 60 and the upper electrode film 80 that corresponds to each of the pressure generation chambers 12 so as to deflect and deform the elastic membrane 50, the insulating film 55, the lower electrode film 60, and the piezoelectric substance layer 70. By this means, the inner pressure of each of the pressure generation chambers 12 is raised so as to eject ink drops from the nozzle orifice 21.

Other Embodiments

Although an exemplary embodiment of the invention is explained above, needless to say, the scope of the invention is in no case limited to any of the above specific examples in the embodiment. For example, in the exemplary embodiment of the invention described above, the gradual diminution portion 17 is configured as a curved surface. Notwithstanding the foregoing, the gradual diminution portion 17 may be made up of a plurality of flat surfaces having angles of gradient that vary/differ from one another in place of a curved surface as long as its angle of gradient gradually decreases. In the exemplary embodiment of the invention described above, the tip surface 11*a* of each of the partition walls 11 is configured as the narrow width portion 16. Notwithstanding the foregoing, needless to say, the narrow width portion 16 may be omitted. In the exemplary embodiment of the invention described above, the tip surface 11*a* of the partition wall 11 is slanted downward from the nozzle plate (20) side toward the elastic membrane (50) side. Notwithstanding the foregoing, the invention may be applied to an alternative configuration in which the tip surface 11*a* of the partition wall 11 is slanted downward from the elastic membrane (50) side toward the nozzle plate (20) side.

It should be noted that the invention has a distinctive feature in the shape of liquid flow channels formed in the fluid channel formation substrate. More particularly, the invention has a distinctive feature in the shape of the tip portions of the partition walls. For this reason, any other part of the configuration is not specifically limited herein. For example, although an ink-jet recording head that is provided with piezoelectric elements as its pressure generation unit is taken as an example for explanation of the exemplary embodiment of the invention described above, the pressure generation unit should be in no case understood to be limited to such a specific example. That is, for example, the pressure generation unit may be alternatively configured as a so-called electrostatic actuator. In the configuration of the electrostatic actuator, for example, a diaphragm and an electrode are arranged with a certain space left therebetween so as to control the vibration of the diaphragm by means of an electrostatic force.

Figure 6:
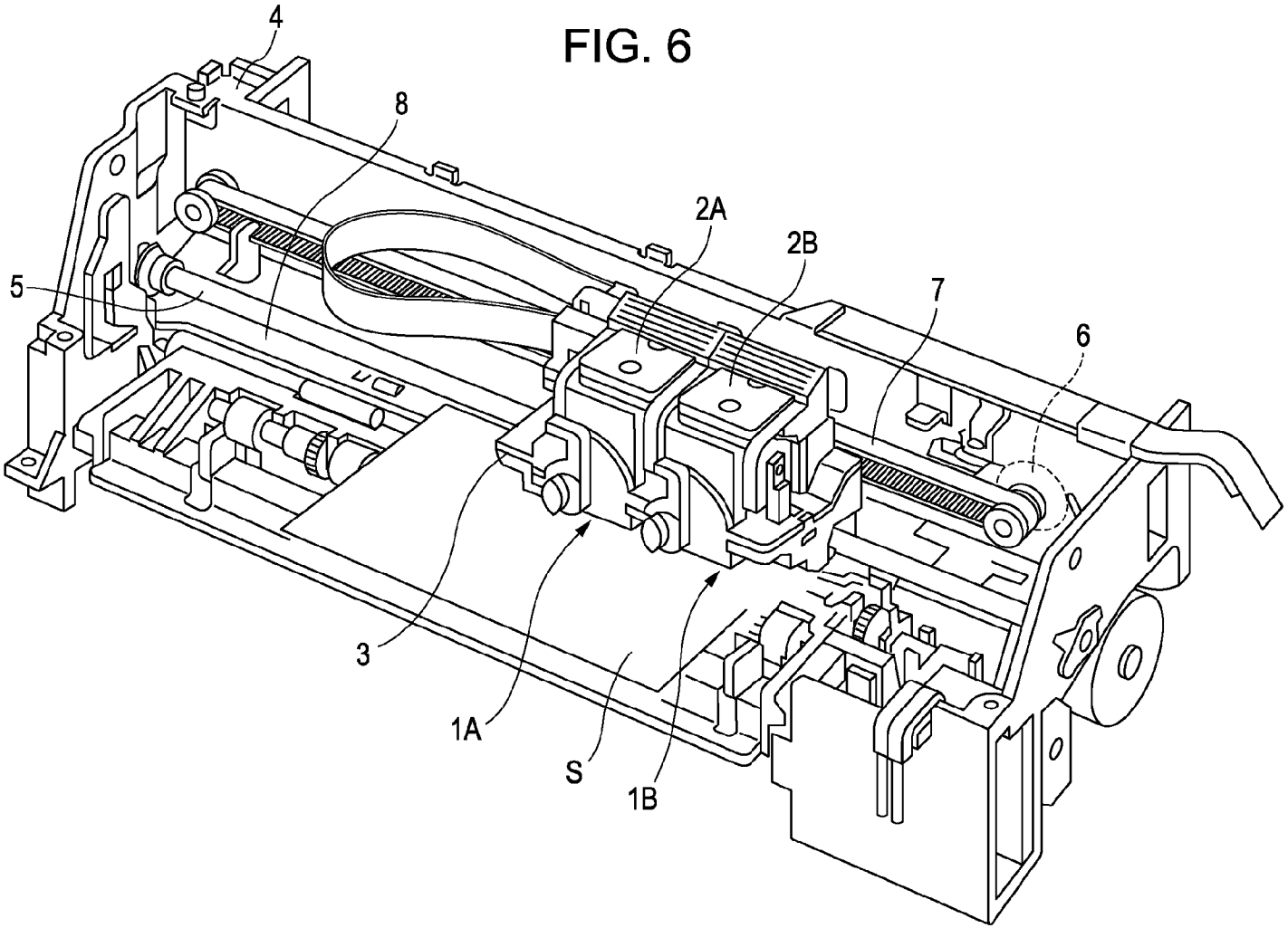
FIG. 6 is a schematic diagram that illustrates an example of an ink-jet recording apparatus according to an embodiment of the invention.

The ink-jet recording head described above constitutes a part of an ink-jet recording head unit. The ink-jet recording head unit has ink flow channels that become in communication with ink cartridges or the like when the ink cartridges are attached thereto. Such an ink-jet recording head unit is mounted on an ink-jet recording apparatus. FIG. 6 is a schematic diagram that illustrates an example of such an ink-jet recording apparatus.

As illustrated in FIG. 6, ink cartridges 2A and 2B, which constitute ink supply units, are detachably attached to ink-jet recording head units 1A and 1B, respectively. The ink-jet recording head units 1A and 1B each of which has an ink-jet recording head are mounted on a carriage 3. The carriage 3 is configured to move freely in the axial direction of a carriage axis 5, which is fixed to an apparatus body chassis 4. The ink-jet recording head units 1A and 1B are configured to eject, for example, black ink compound and color ink compound, respectively. The driving force of a driving motor 6 is communicated/transmitted to the carriage 3 by means of a plurality of gears that are not shown in the drawing and a timing belt 7, the carriage 3 with the ink-jet recording head units 1A and 1B mounted thereon is moved along the carriage axis 5. On the other hand, a platen 8 is provided in the apparatus body chassis 4 along the carriage axis 5. A recording sheet S, which is a recording target medium (i.e., print target medium) such as a sheet of paper that is supplied by a paper feed roller that is not shown in the drawing, is wound around the platen 8 for transport thereof.

In the embodiment of the invention described above, the invention is explained while exemplifying an ink-jet recording head as a typical example of a liquid ejecting head. Notwithstanding the foregoing, the invention is directed to various kinds of liquid ejecting heads; and therefore, needless to say, the invention is also applicable to a variety of liquid ejecting heads that eject liquid other than ink. Liquid ejecting heads to which the invention is applicable encompass a wide variety of heads; specifically, they include without any limitation thereto: a variety of recording heads that are used in an image recording apparatus such as a printer or the like, a color material ejection head that is used in the production of color filters for a liquid crystal display device or the like, an electrode material (i.e., conductive paste) ejection head that is used for electrode formation for an organic EL display device or a surface/plane emission display device (FED, field emission display) and the like, a living organic material ejection head that is used for production of biochips.

What is claimed is:

1. A liquid ejecting head comprising:

a fluid channel formation substrate that is made of a silicon single crystal substrate having a crystal face orientation of (110), the fluid channel formation substrate having a plurality of separate flow channels that include at least pressure generation chambers demarcated by a row of partition walls, each of the pressure generation chambers being in communication with a nozzle opening that ejects liquid drops, and the fluid channel formation substrate further having a communication portion that is in communication with each of the separate flow channels; and a pressure generation section that is provided so as to correspond to each of the pressure generation chambers, the pressure generation section generating a pressure change in the pressure generation chambers so as to cause ejection of liquid drops, wherein the tip surface at the communication portion side of each of the partition walls has a gradual diminution portion formed thereon, the gradual diminution portion being, in the thickness direction perpendicular to the row of the partition walls, slanted downward toward the communication portion, and the gradual diminution portion having an angle of gradient that gradually decreases toward one end portion of the partition wall, wherein the each of the gradual diminution portions is configured as a plurality of surfaces.

2. A liquid ejecting apparatus that is provided with the liquid ejecting head according to claim 1.

3. The liquid ejecting head according to claim 1, wherein the entire region of the tip surface of each of the partition walls is slanted downward toward the communication portion.

4. The liquid ejecting head according to claim 3, wherein the gradual diminution portion only constitutes the tip surface of each of the partition walls.

5. The liquid ejecting head according to claim 1, wherein an end portion of each of the partition walls at the communication-portion side is configured as a narrow width portion that has a decreasing width toward a tip thereof.

6. The liquid ejecting head according to claim 1, wherein each of the separate flow channels includes a liquid supply passage that is in communication with the pressure generation chamber and is configured to have a relatively small sectional area along a width direction thereof in comparison with that of the pressure generation chamber, and said each of the separate flow channels further includes a communication passage through which the liquid supply passage is in communication with the communication portion, the communication passage being configured to have a relatively large sectional area along a width direction thereof in comparison with that of the liquid supply passage.

7. A liquid ejecting head comprising:

a fluid channel formation substrate that is made of a silicon single crystal substrate having a crystal face orientation of (110), the fluid channel formation substrate having a plurality of separate flow channels that include at least pressure generation chambers demarcated by partition walls, each of the pressure generation chambers being in communication with a nozzle opening that ejects liquid drops, and the fluid channel formation substrate further having a communication portion that is in communication with each of the separate flow channels; and a pressure generation section that is provided so as to correspond to each of the pressure generation chambers, the pressure generation section generating a pressure change in the pressure generation chambers so as to cause ejection of liquid drops, wherein the tip surface at the communication portion side of each of the partition walls has a gradual diminution portion formed thereon, the gradual diminution portion being, in the thickness direction of the partition wall, slanted downward toward the communication portion, and the gradual diminution portion having an angle of gradient that gradually decreases toward one end portion of the partition wall, wherein the gradual diminution portion is configured as a plurality of surfaces.

* * * * *